US008998278B2

(12) United States Patent
Wilde et al.

(10) Patent No.: US 8,998,278 B2
(45) Date of Patent: Apr. 7, 2015

(54) STRIKER CONCEALMENT MECHANISM AND METHOD

(75) Inventors: Ronald J. Wilde, St. Clair Shores, MI (US); Jeffrey S. Hamminga, Troy, MI (US); Eric Hansen, Lake Orion, MI (US)

(73) Assignee: Strattec Power Access LLC, Auburn Hills, MI (US)

( * ) Notice: Subject to any disclaimer, the term of this patent is extended or adjusted under 35 U.S.C. 154(b) by 242 days.

(21) Appl. No.: 13/546,844

(22) Filed: Jul. 11, 2012

(65) Prior Publication Data

US 2013/0038075 A1 Feb. 14, 2013

Related U.S. Application Data

(60) Provisional application No. 61/506,462, filed on Jul. 11, 2011.

(51) Int. Cl.

| | |
|---|---|
| ***E05B 15/02*** | (2006.01) |
| ***E05B 79/20*** | (2014.01) |
| ***E05B 81/00*** | (2014.01) |
| ***E05B 85/04*** | (2014.01) |
| *E05C 1/06* | (2006.01) |

(52) U.S. Cl.

CPC ..... *E05B 79/20* (2013.01); *E05B 81/00* (2013.01); *E05B 85/045* (2013.01); *E05B 15/029* (2013.01)

(58) Field of Classification Search

CPC .. E05B 15/0205; E05B 15/029; E05B 17/002
USPC ..... 292/144, 340, 341.14–341.16; 296/146.9

See application file for complete search history.

(56) References Cited

U.S. PATENT DOCUMENTS

| | | | | |
|---|---|---|---|---|
| 309,238 | A * | 12/1884 | Mix | 292/341.14 |
| 518,405 | A * | 4/1894 | Heymanson | 292/341.14 |
| 3,458,227 | A * | 7/1969 | Bryson et al. | 292/341.14 |
| 4,453,752 | A * | 6/1984 | McKann | 292/341.19 |

(Continued)

FOREIGN PATENT DOCUMENTS

| | | | |
|---|---|---|---|
| DE | 19732999 A1 * | 2/1999 | |
| DE | 10017310 A1 * | 10/2001 | B04B 7/02 |

(Continued)

OTHER PUBLICATIONS

Images of Audi Q7 Liftgate Latch Surround, publicly available prior to Jul. 11, 2011.

*Primary Examiner* — Carlos Lugo
(74) *Attorney, Agent, or Firm* — Michael Best & Friedrich LLP

(57) ABSTRACT

A vehicle closure assembly includes a closure movable relative to a vehicle opening between closed and open positions. A latch is coupled to one of a threshold of the vehicle opening and the closure, and a striker is coupled to the other of the threshold of the vehicle opening and the closure. The striker and latch are engageable to secure the closure in the closed position. A striker cover is movable relative to the striker between a concealing position in which the striker is substantially concealed from the latch, and an exposing position in which the striker is substantially exposed to the latch. An actuator is coupled to the striker cover and is operable to move the striker cover to the concealing position or the exposing position from the other position in response to movement of the closure relative to the vehicle opening.

24 Claims, 10 Drawing Sheets

(56) References Cited

U.S. PATENT DOCUMENTS

| | | | | | |
|---|---|---|---|---|---|
| 4,901,474 | A | * | 2/1990 | Bayard et al. | 49/26 |
| 6,009,668 | A | * | 1/2000 | Reddy | 49/280 |
| 6,581,991 | B2 | * | 6/2003 | Galindo | 292/341.16 |
| 8,469,440 | B2 | * | 6/2013 | Thorpe et al. | 296/146.9 |
| 8,550,508 | B2 | * | 10/2013 | Gentile et al. | 292/341.15 |
| 2014/0265377 | A1 | * | 9/2014 | Gardner et al. | 292/341.14 |

FOREIGN PATENT DOCUMENTS

| | | | | |
|---|---|---|---|---|
| DE | 10007420 | B4 | * | 2/2008 |
| DE | 102006044953 | B4 | * | 1/2010 |
| DE | 102009027325 | B4 | * | 6/2011 |
| DE | 102011121892 | | * | 6/2014 |
| FR | 2625246 | | * | 6/1989 |
| GB | 677953 | | * | 8/1952 |
| WO | WO 2004060720 | A2 | * | 7/2004 |

* cited by examiner

STRIKER CONCEALMENT MECHANISM AND METHOD

CROSS-REFERENCE TO RELATED APPLICATIONS

This application is a non-provisional of U.S. Provisional Patent Application Ser. No. 61/506,462, filed Jul. 11, 2011, the entire contents of which are incorporated by reference herein.

BACKGROUND

The present application relates to latch assemblies of vehicular closures, such as decklids, doors, tailgates, liftgates, hatchbacks, glove compartments, etc., which include a latch and a striker.

SUMMARY

In some embodiments, the present invention provides a mechanism for selectively concealing a striker on an automobile. The mechanism includes a door and an actuator coupled to the door. The actuator is also coupled to a vehicular closure (e.g., decklid, door, tailgate, liftgate, hatchback, glove compartment, or any other closure movable to and from a position in which the closure closes an exterior opening of a vehicle or a compartment within a vehicle). As the vehicular closure is opened, the door is moved to a first position to cover the striker and, as the vehicular closure is closed, the door is moved to a second position to allow access to the striker.

In some embodiments, the present invention provides a method of selectively concealing a striker on an automobile. The mechanism includes providing a door and an actuator coupled to the door. The method includes coupling the actuator to a vehicular closure, moving the door to a first position to cover the striker as the vehicular closure is opening, and moving the door to a second position to allow access to the striker as the vehicular closure is closing.

Other aspects of the invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
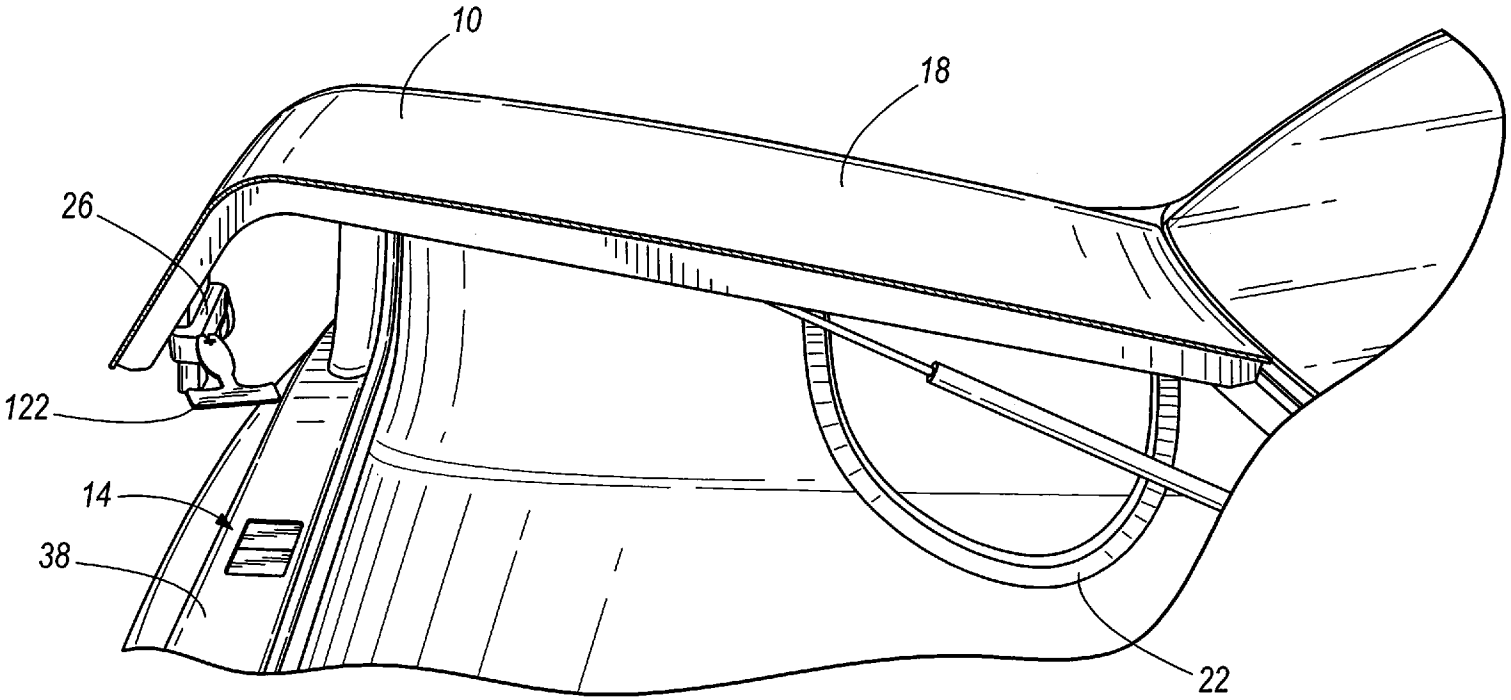
FIG. 1 illustrates a decklid and a striker concealment mechanism according to an embodiment of the present invention, the decklid being open and the striker concealment mechanism being in a closed position.

FIG. 1 illustrates a vehicle closure assembly. The vehicle closure assembly includes a vehicle closure, which is a decklid 10 in the illustrated construction, and a striker concealment mechanism 14. The decklid 10 is usable with a vehicle to selectively cover and uncover a trunk or storage space of a vehicle by closing or opening an access opening to the trunk or storage space. The illustrated decklid 10 includes a body 18, a hinge 22 that pivotally couples the body 18 to the vehicle, and a latch mechanism 26 coupled to the body 18. The illustrated hinge 22 includes a gooseneck hinge, but may alternatively include a four-bar linkage or other hinge 22 suitable for pivotably coupling the decklid 10 to the vehicle. The latch mechanism 26, or simply "latch" releasably engages a striker 30 (FIGS. 2 and 3) on the automobile to secure the decklid 10 in a closed position (FIG. 4). The latch 26 and the striker 30 form a latching assembly. In the illustrated embodiment, the decklid 10 is a non-powered decklid that pivots vertically about a horizontal axis. In other embodiments, the decklid 10 may be a powered decklid.

Although the vehicle closure illustrated in the accompanying figures is a decklid 10, it will be appreciated that the present invention can be used in any other vehicle closure applications in which a latch mechanism releasably engages with a striker of any type (e.g., post, U-shaped element, and the like) to selectively latch and release the closure relative to a vehicle opening. By way of example only, the striker concealment mechanism of the present invention can instead be used for the striker of a powered or non-powered door, tailgate, liftgate, hatchback, glove compartment, or any other closure movable to and from a position in which the closure closes an exterior opening of a vehicle or a compartment within a vehicle. Also, such vehicle closures need not necessarily pivot vertically about a horizontal axis as discussed above in connection with the illustrated decklid 10. Instead, other vehicle closures can instead pivot horizontally about a vertical axis, pivot about any other axis, and/or slide.

Figure 2:
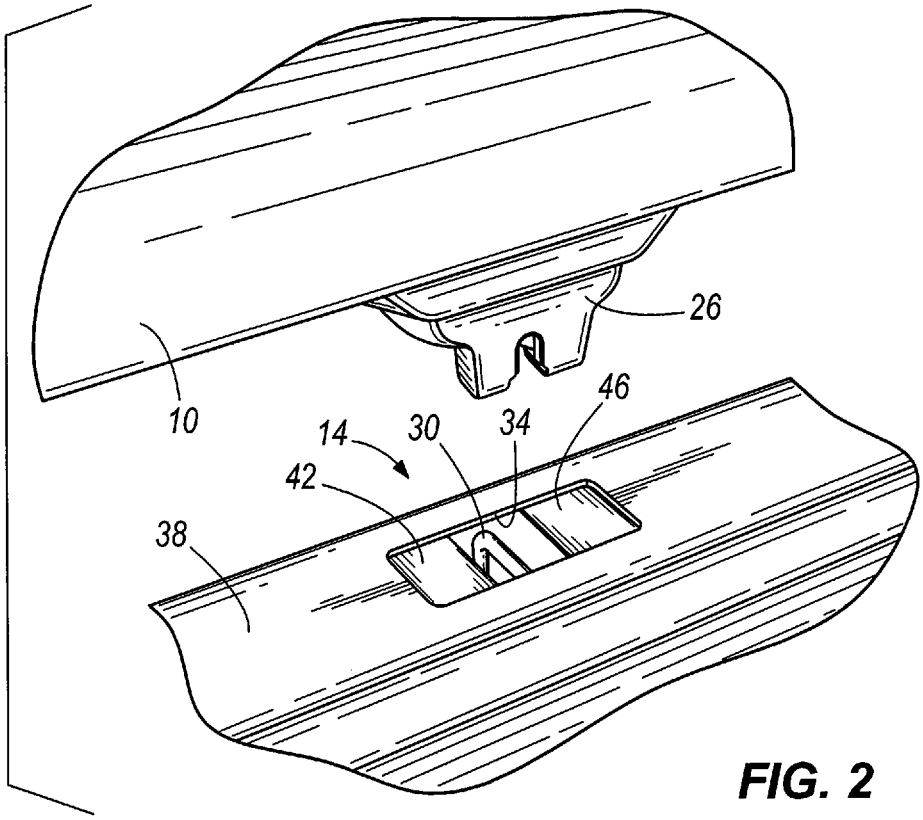
FIG. 2 illustrates the striker concealment mechanism of FIG. 1 in a partially open position.
Figure 3:
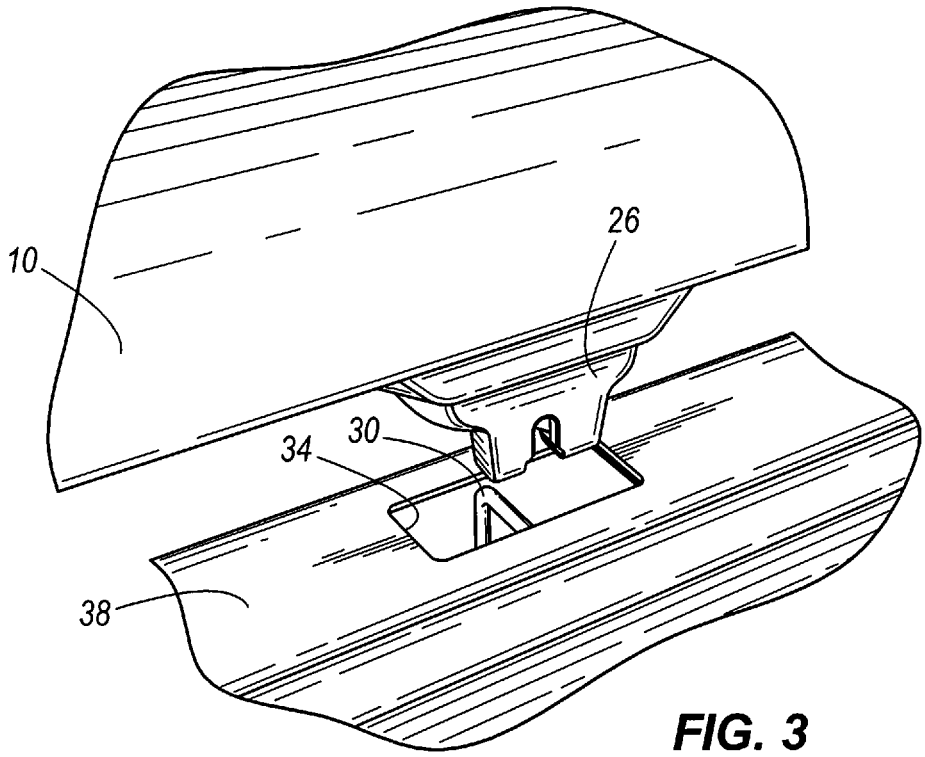
FIG. 3 illustrates the striker concealment mechanism of FIG. 1 in an open position.
Figure 4:
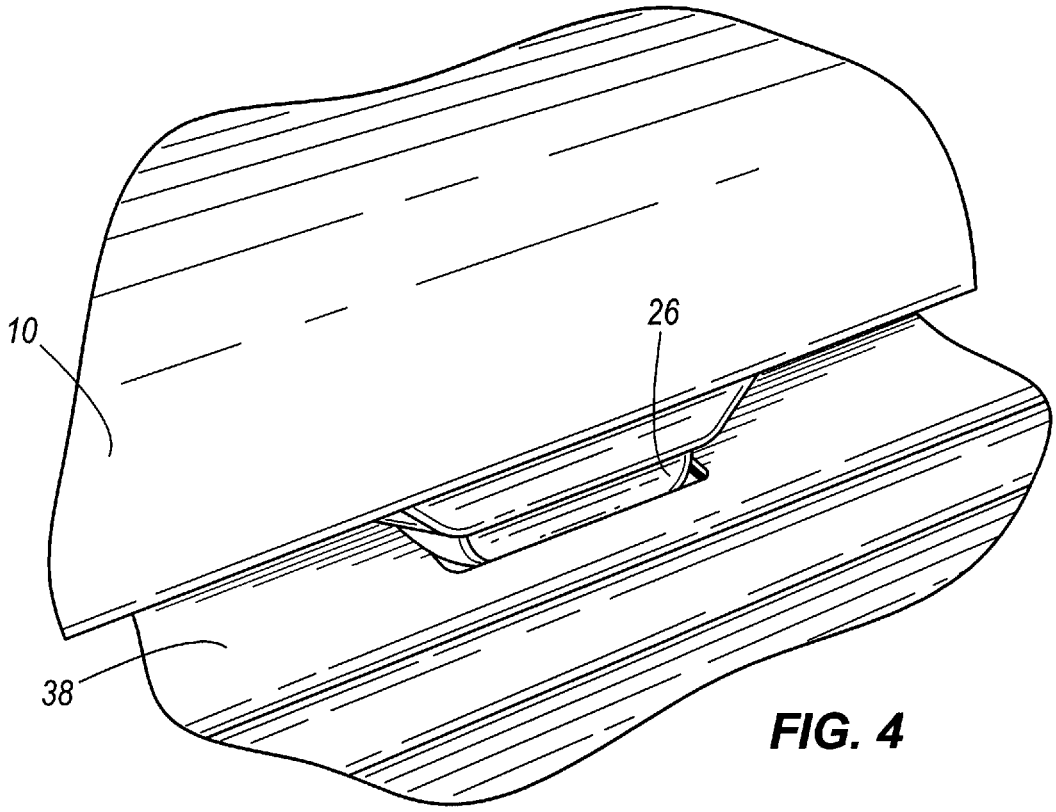
FIG. 4 illustrates the striker concealment mechanism of FIG. 1 in the open position when the decklid is closed.

As shown in FIGS. 2-4, the striker 30 is positioned within a recess and is accessible through an opening 34 provided in a storage space threshold 38 of the automobile (which could instead be a door pillar, body panel, or other portion of a vehicle body, depending upon the application of the striker concealment mechanism). The illustrated striker concealment mechanism 14 is coupled to the threshold 38 to selectively cover and uncover the opening 34, thereby selectively revealing the striker 30. The striker concealment mechanism 14 covers the striker 30 when the decklid 10 is open (FIG. 1) to inhibit dirt and debris from entering the opening 34. The striker concealment mechanism 14 also improves the craftsmanship and appearance of the automobile's trim and scuff areas. As the decklid 10 is being closed (FIGS. 2 and 3), the striker concealment mechanism 14 automatically uncovers the opening 34 to allow the latch mechanism 26 to access to the striker 30.

Figure 5:
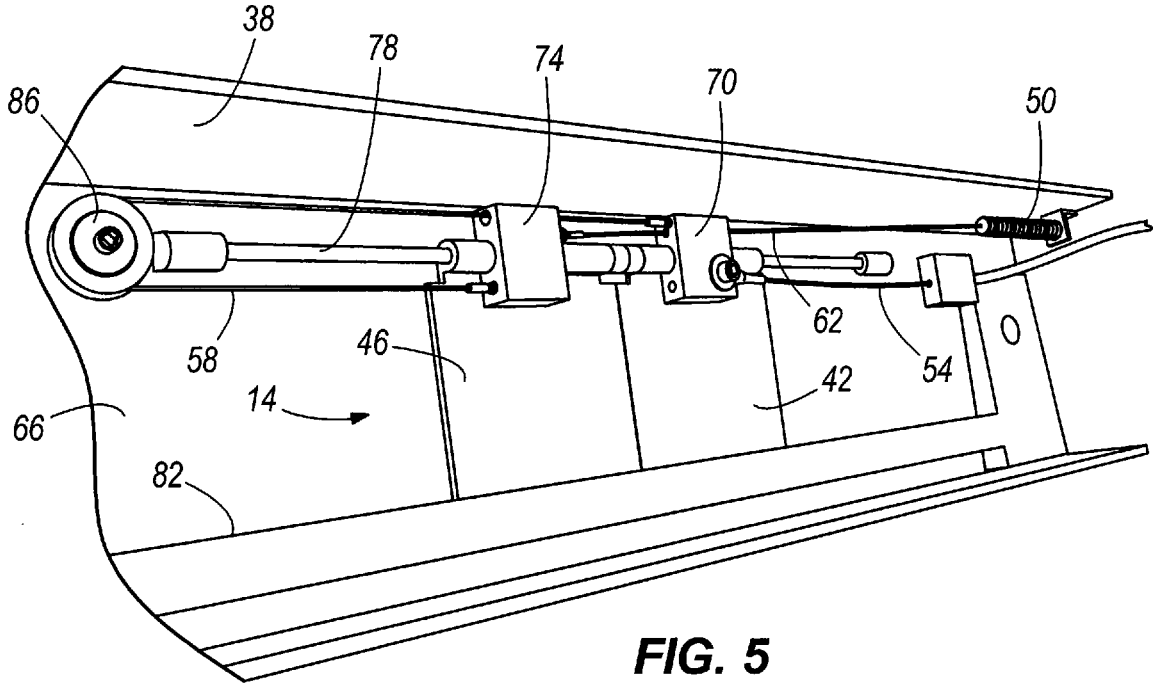
FIG. 5 is an underside view of the striker concealment mechanism of FIG. 1.

As shown in FIG. 5, the illustrated striker concealment mechanism 14 includes a first striker cover or "door" 42, a second striker cover or "door" 46, a biasing mechanism 50, a first cable 54 coupled to the first door 42, a second cable 58 coupled to the first door 42 and the second door 46, and a third cable 62 coupled to the biasing mechanism 50 and the second door 46. The doors 42, 46 are slidably coupled to an underside 66 of the threshold 38. In the illustrated embodiment, the doors 42, 46 are two discrete, relatively thin plates that come together to cover the opening 34 in the threshold 38. In other embodiments, the striker concealment mechanism 14 may include a single plate that slides across the entire opening 34 to cover the opening 34. Each of the illustrated doors 42, 46 includes a bracket 70, 74 that couples to a shaft 78 extending across the underside 66 of the threshold 38. Edges of the doors 42, 46 opposite the brackets 70, 74 are partially received in a track 82 formed on the threshold 38. The brackets 70, 74, the shaft 78, and the track 82 guide and constrain movement of the doors 42, 46 to maintain the doors 42, 46 in close proximity to the underside 66 of the threshold 38.

The cables 54, 58, 62 are actuator members that extend between the decklid 10, the doors 42, 46, and the biasing mechanism 50 to actuate the striker concealment mechanism 14. The illustrated cables 54, 58, 62 link the doors 42, 46 together such that movement between the open position (FIG. 3) and the closed position (FIGS. 1 and 5) is synchronized. In other embodiments, the actuator members may be linkages, gears and gear racks, or any combination thereof with or without cables, and the like.

Figure 6:
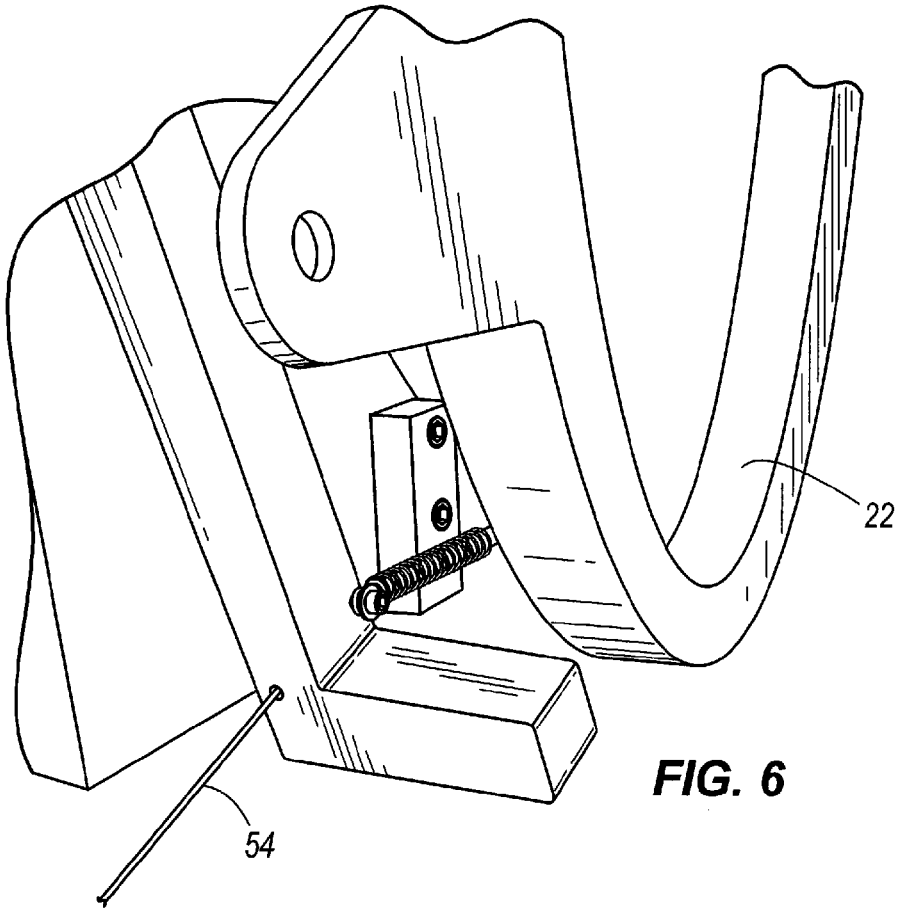
FIG. 6 illustrates a hinge of the decklid shown in FIG. 1.

In the illustrated embodiment, the first cable 54 is secured (e.g., fixed or anchored) to the hinge 22 of the decklid 10 (FIG. 6) and to the bracket 70 of the first door 42. The second cable 58 is secured to the bracket 70 of the first door 42, wraps around a pulley 86 on the underside 66 of the threshold 38, and is secured to the bracket 74 of the second door 46. As the decklid 10 is closed, the hinge 22 tensions the first cable 54 to move (e.g., pull) the first door 42 to the open position. As the first door 42 slides to the open position, the first door 42 tensions the second cable 58 to also move (e.g., pull) the second door 46 to the open position.

The doors 42, 46 are biased to the closed position by the biasing mechanism 50 and the second and third cables 58, 62. The biasing mechanism 50 may include, for example, a coil spring coupled to the third cable 62. The third cable 62 extends from the biasing mechanism 50 and is secured to the bracket 74 of the second door 46. As the decklid 10 is opened, the hinge 22 slackens the first cable 54, allowing the biasing mechanism 50 and the third cable 62 to move (e.g., pull) the second door 46 to the closed position. As the biasing mechanism 50 tensions the third cable 62 to slide the second door 46 to the closed position, the second door 46 tensions the second cable 58 to also move (e.g., pull) the first door 42 to the closed position.

In other embodiments, the cables 54, 58, 62 may be arranged such that the hinge 22 and the first cable 54 pull the doors 42, 46 toward each other (i.e., to the closed position) and the biasing mechanism 50 and the third cable 62 bias the doors 42, 46 away from each other (i.e., to the open position). Alternatively, in further embodiments, the biasing mechanism 50 may be omitted such that cables alone move the doors 42, 46 between the open position and the closed position as the decklid 10 is opened and closed.

When the decklid 10 is open (FIG. 1), the striker concealment mechanism 14 is in the closed position such that the doors 42, 46 cover the opening 34 in the threshold 38 and inhibit access to the striker 30. As the body 18 of the decklid 10 is pivoted about the hinge 22 to close the decklid 10, the hinge 22 tensions the first cable 54, pulling the doors 42, 46 away from each other against the force of the biasing mechanism 50 (FIG. 2). The first and second cables 54, 58 pull the doors 42, 46 until the doors are at least partially or completely retracted under the threshold 38, and the striker 30 is accessible through the opening 34 (FIG. 3). The decklid 10 is then fully closed by pivoting the body 18 until the latch mechanism 26 enters the opening 34 and engages the striker 30 (FIG. 4).

To open the decklid 10, a release device 122 (e.g., a door or trunk handle, a safety release, etc.) (FIG. 1) is actuated by a user to disengage the latch mechanism 26 from the striker 30. The body 18 of the decklid 10 then pivots about the hinge 22 away from the threshold 38. As the decklid 10 is opening, the hinge 22 slackens the first cable 54. With the first cable 54 slackened, the biasing mechanism 50 tensions the third cable 62 to pull the doors 42, 46 toward each other. The biasing mechanism 50 continues to pull the doors 42, 46 together until the doors 42, 46 substantially close the opening 34 and conceal the striker 30. In some constructions, the doors 42, 46 may contact each other to completely inhibit access to the striker 30.

The illustrated striker concealment mechanism 14 is thereby mechanically actuated to remain functional and operational during a loss of power condition (e.g., when the automobile is not running or when the vehicle battery is dead). In other embodiments, the striker concealment mechanism 14 may be actuated by a separate manual or automatic actuator (as discussed below), rather than by the hinge 22 of the decklid 10 and the cables 54, 58, 62. Alternatively, the striker concealment mechanism 14 may be actuated by another feature of the automobile.

Figure 7:
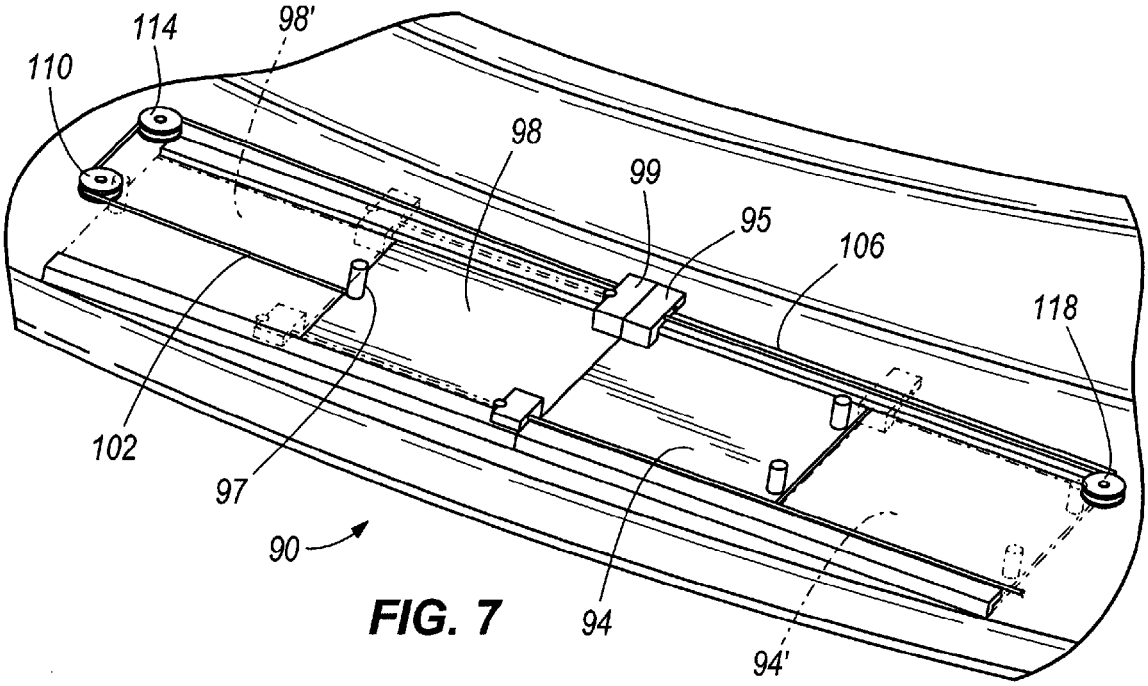
FIG. 7 is an underside view of another embodiment of a striker concealment mechanism.

FIG. 7 illustrates another embodiment of a striker concealment mechanism 90 that can be provided as part of any one of a wide range of vehicle closure assemblies as described above. The illustrated striker concealment mechanism 90 of FIG. 7 is similar to the striker concealment mechanism 14 discussed above, and includes two doors 94, 98. However, in the illustrated embodiment of FIG. 7, two cables 102, 106 actuate the doors 94, 98, and multiple pulleys 110, 114 are provided to guide the cable 102 which synchronizes the movement of the doors. The cables 102, 106 and the pulleys 110, 114 are mounted to the underside 66 of the threshold 38 to actuate the doors 94, 98.

A significant difference from the earlier embodiment is that the striker concealment mechanism 90 of FIG. 7 is configured to bias the doors 94, 98 to their open positions (as labeled 94', 98'). Springs (not shown) are provided to push each of the doors 94, 98 toward its open position (laterally outward away from each other in the illustrated construction). To actuate the doors 94, 98 to their closed positions, the cable 106 is pulled by the opening of the decklid or other vehicle closure. The cable 106, which may optionally be guided over one or more pulleys 118, extends from one side of the mechanism 90 across the central mating interface and is secured to the door 98 so that pulling of the cable 106 (to the right in FIG. 7) pulls the door 98 toward its closed position. The cable 106 can be secured to a bracket 99 on the door 98 at one end, while the other end of the cable 106 can be secured to a portion of the vehicle closure or associated hardware which moves with the vehicle closure. As the door 98 is pulled closed, the additional cable 102 actuates the door 94 to move to its corresponding closed position. In the illustrated construction, the cable 102 extends over two pulleys 110, 114 to reverse the actuation direction provided by the closing of the direct-actuated door 98. One end of the cable 102 can be secured to a bracket or post 97 of the door 98, while the other end is secured to a bracket 95 on the door 94. When the decklid or other corresponding vehicle closure is moved toward the closed position, the cable 106 is allowed increasing slack, and the springs move the doors 94, 98 open to allow access to the striker for latching.

Figure 8:
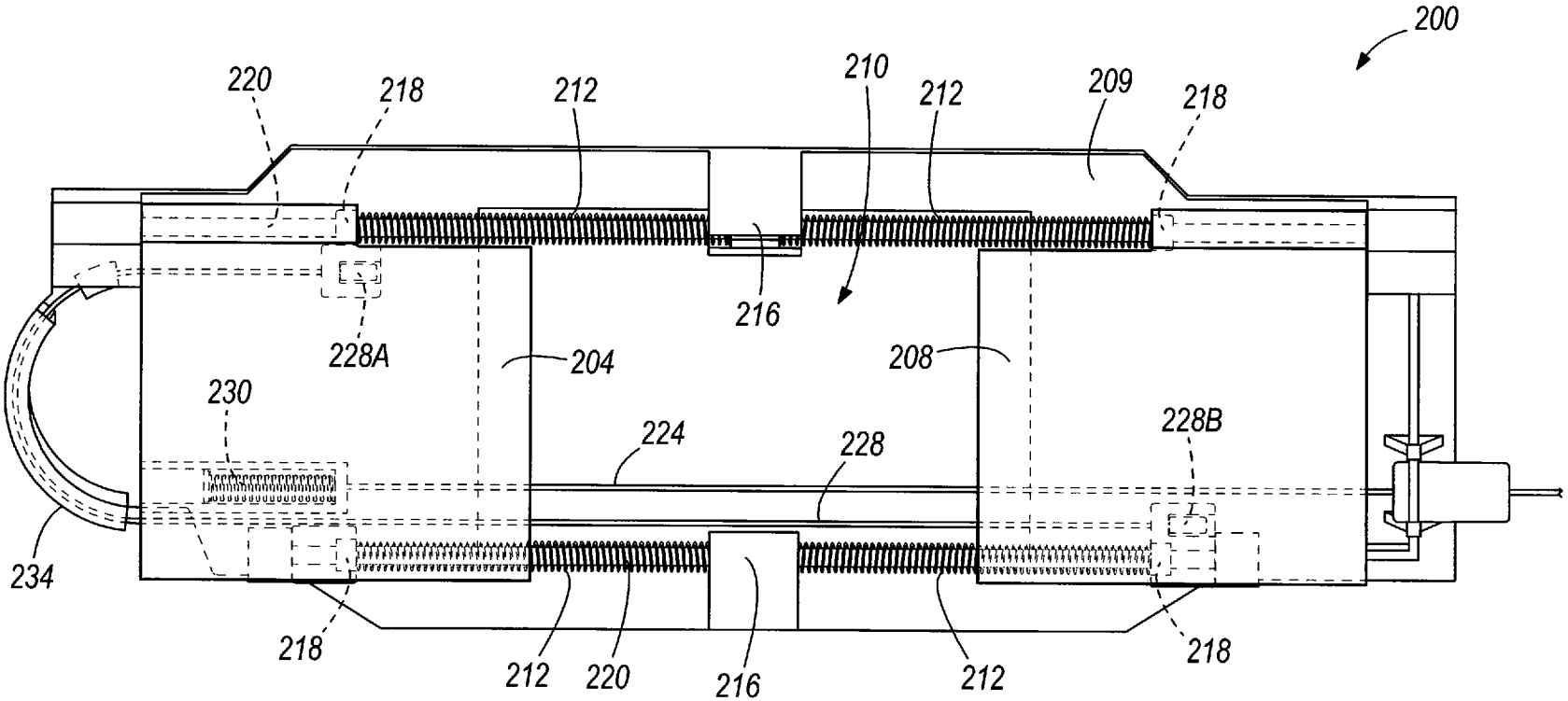
FIG. 8 is a front view of another embodiment of a striker concealment mechanism, shown in an open configuration.
Figure 9:
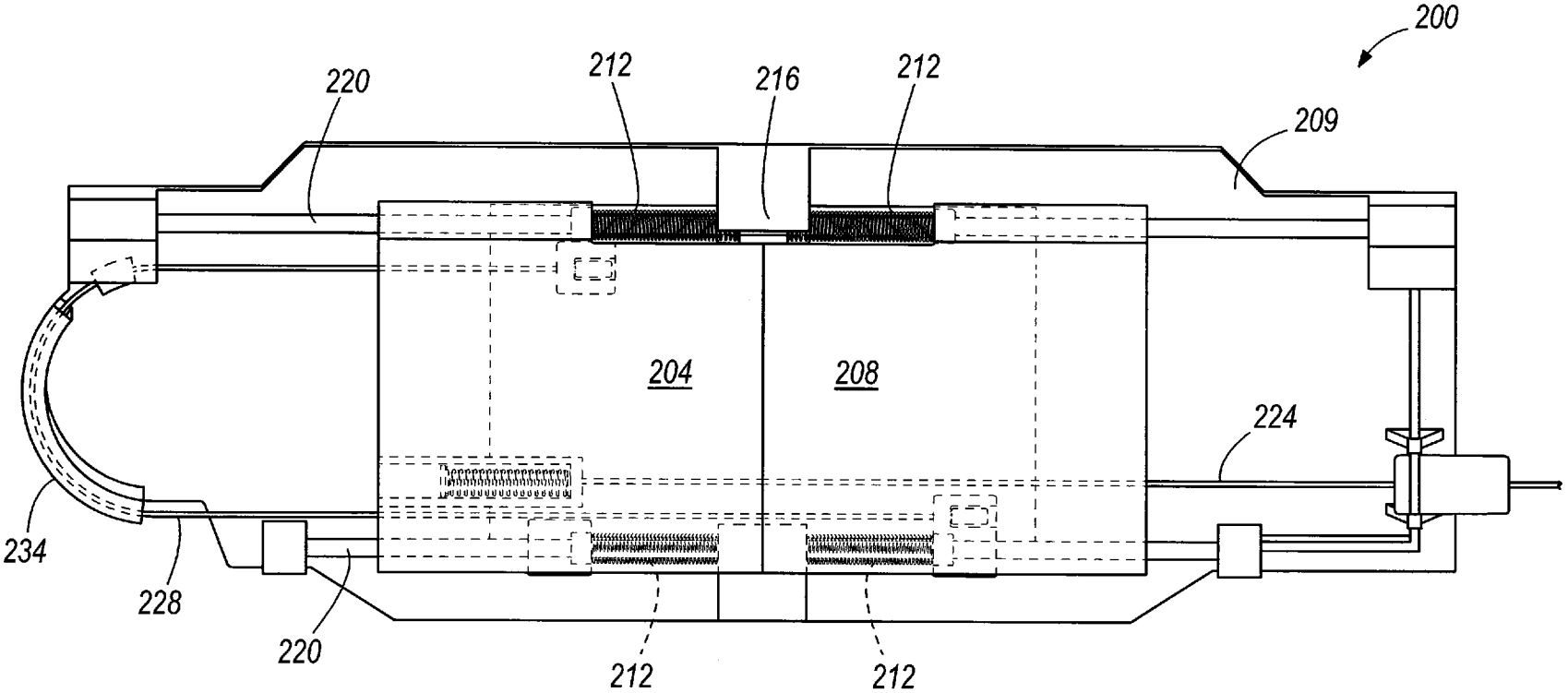
FIG. 9 is a front view of the striker concealment mechanism of FIG. 8, shown in a closed configuration.
Figure 10:
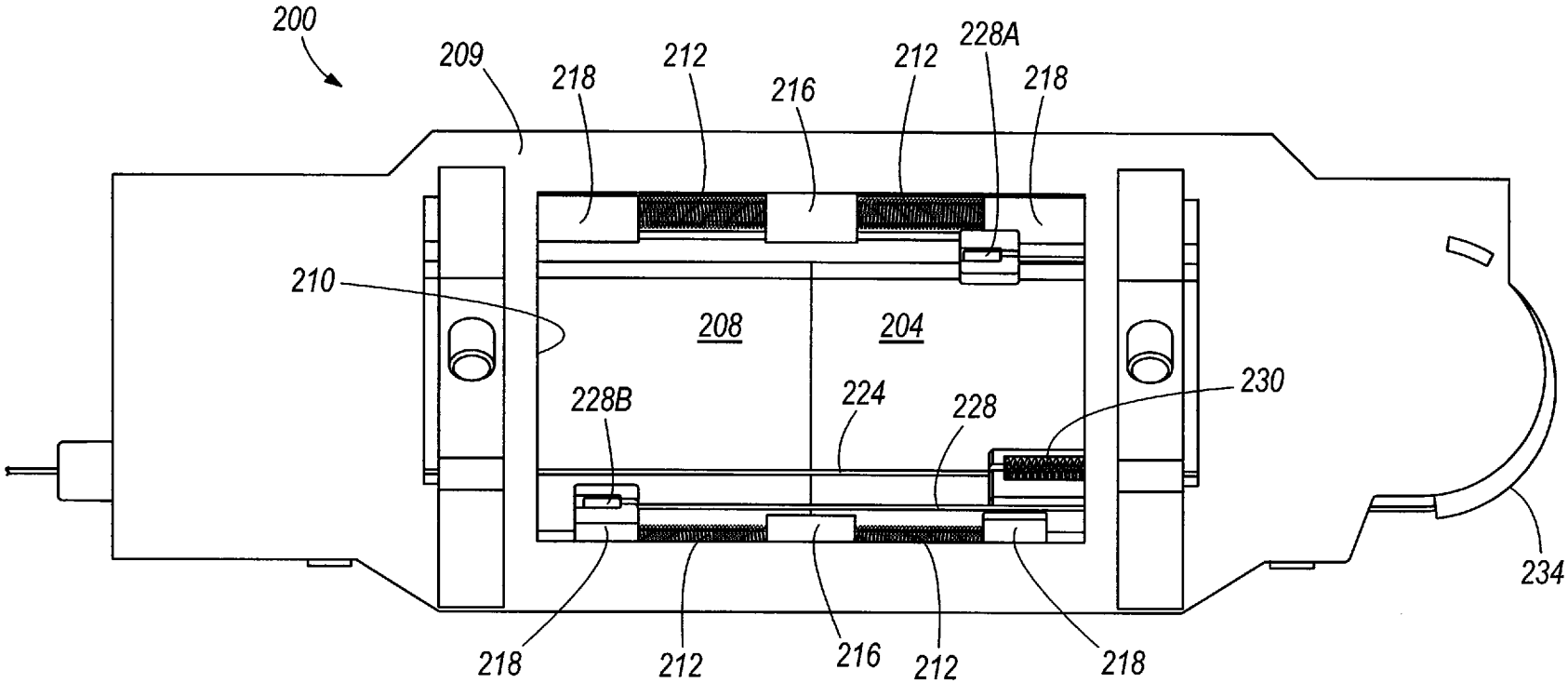
FIG. 10 is a rear view of the striker concealment mechanism of FIGS. 8-9.

FIGS. 8-10 illustrate another embodiment of a striker concealment mechanism 200 that can be provided as part of any one of a wide range of vehicle closure assemblies as described above. The illustrated striker concealment mechanism 200 of FIGS. 8-10 has similarities to the striker concealment mechanisms 14, 90 described above. However, additional details are described below with particular reference to FIGS. 8-10.

The striker concealment mechanism 200 includes at least one cover or door, and in the illustrated construction, includes two doors 204, 208 slidable linearly (e.g., laterally) toward and away from each other relative to a housing or backing plate 209. The doors 204, 208 are shown as semi-transparent in FIGS. 8 and 9 to illustrate underlying components. As shown in FIG. 8, the doors 204, 208 can be provided in an open configuration to allow access through an opening 210 to a striker (not shown) for latching. FIG. 9 illustrates the doors 204, 208 in a closed configuration in which the striker is substantially covered and concealed. As described in further detail below, each of the doors 204, 208 is biased to its respective open position. This ensures that any failure of the actuation mechanism results in the striker being accessible for latching.

To bias the doors 204, 208 open, one or more springs 212 are provided. In the illustrated construction, four springs 212 are provided, but more or fewer springs can be provided in other constructions. Each of the springs 212 is positioned between a central stationary spacer block 216 and a corresponding abutment portion 218 of each door 204, 208. When the actuation mechanism, described below, is not actuated the springs 212 open the doors 204, 208 and return the actuation mechanism to a home position. The springs 212 can be positioned on a pair of guide rods or guide rails 220 provided on opposing sides of the opening 210 and extending parallel to the sliding direction of the doors 204, 208. The guide rails 220 also interface with the doors 204, 208 to guide the motion thereof between open and closed positions.

The actuation mechanism includes two cables 224, 228 in the illustrated construction. The first cable 224 extends from the side of the second door 208 toward the opposing first door 204. The first cable 224 is coupled to the first door 204 through a lost motion connection, such as a spring 230, rather than a fixed connection. In this way, the doors 204, 208 can be ensured to be tightly closed, without an unsightly gap when the vehicle closure is opened. This also prevents the doors 204, 208 from being crushed towards each other with great force in the event that the actuation mechanism is not properly installed or adjusted.

In addition to the primary cable 224 which acts directly on the first door 204, the second cable 228 is provided to substantially synchronize the motion of the second door 208 with that of the first door 204 so that the second door 208 substantially mirrors the motion of the first door 204. The second cable 228 is secured at one end 228A to the first door 204. The second cable 228 extends from the first end 228A in a direction away from the second door 208, around a 180 degree guideway 234 (e.g., stationary sliding channel, pulley, etc.) and then toward the second door 208. The guideway 234 is similar in width to the width of the opening 210 so that the cable 228 does not substantially interfere with the opening 210. From the guideway 234, the second cable 228 extends across the first door 204 and the opening 210 and is secured to the second door 208 at its second end 228B. Thus, the motion of the first door 204 is reversed for actuating the second door 208. Other constructions are contemplated, including those with more or fewer doors and alternate synchronizing devices.

Figure 11:
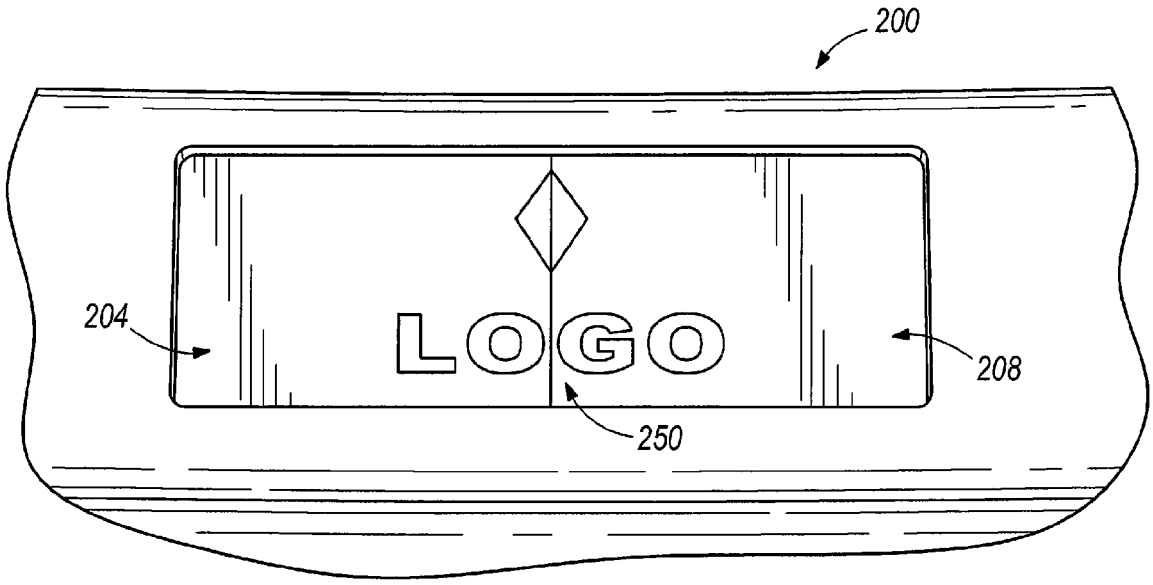
FIG. 11 is front view of the striker concealment mechanism of FIGS. 8-10, assembled with a vehicle and provided with a logo and backlighting.
Figure 12:
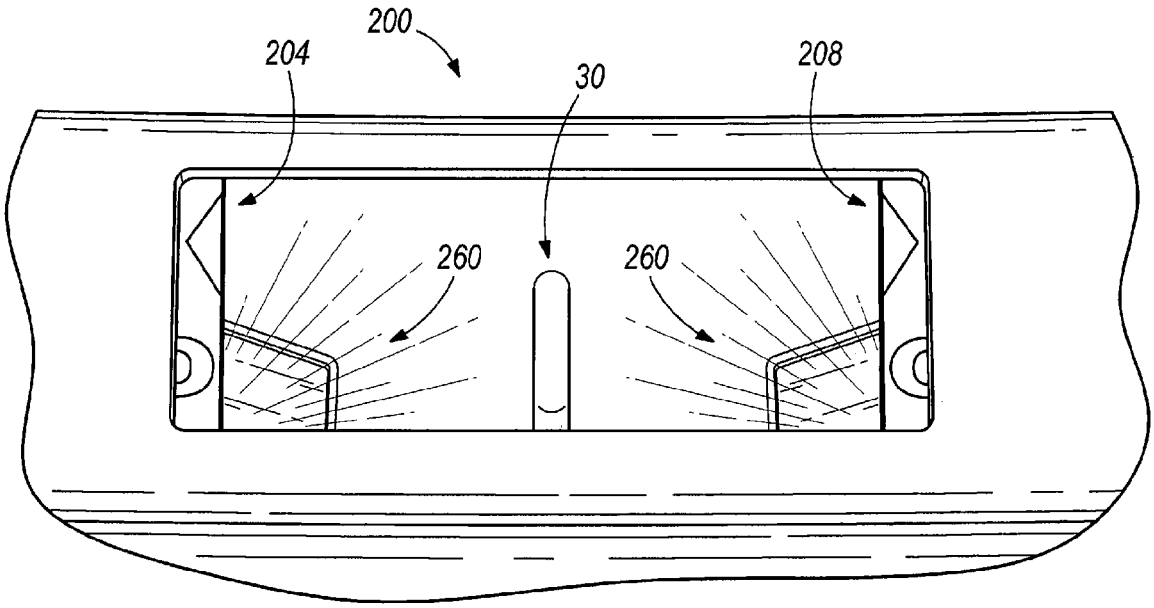
FIG. 12 is a front view of the striker concealment mechanism of FIG. 11, shown open to illustrate a lighting assembly.

FIGS. 11 and 12 illustrate the striker concealment mechanism 200 of FIGS. 8-10, which is modified to incorporate additional enhancements, including backlighting. As shown in the drawings, the doors 204, 208 can be provided with a design, which may include a pictographic or alpha-numeric logo 250 or other design. The logo 250 can be provided by providing the characters with different light transmissive properties in comparison to the other portions of the doors 204, 208. For example, the doors 204, 208 can be constructed of a substantially transparent or translucent material which transmits visible light (e.g., white ABS plastic), and the characters of the logo 250 can be provided by a light mask that covers substantially all portions of the doors 204, 208 except for the character portions. This can be done by screen printing the entire door surface with the mask and then selectively removing portions of the mask, such as by laser or other removal means. If desired, the light transmissive properties can be reversed if desired so that the characters are the only portion of the doors 204, 208 that are not light transmissive.

At least one light source 260 is provided underneath the doors 204, 208 to shine substantially upward through the logo 250 in the doors 204, 208. In the illustrated construction, two light sources 260 are provided to substantially eliminate shadowing caused by the striker 30 (FIG. 12). Each light source 260 can be angled substantially inward toward center and upward. The light sources 260 can be LEDs or another suitable light source. The light sources 260 are configured for illuminating the doors 204, 208 selectively based on their open/closed configuration. For example, the light sources 260 can be illuminated in response to the doors 204, 208 closing. Because the closing of the doors 204, 208 occurs in response to the opening of the vehicle closure (e.g., decklid, etc.), the illumination of the light sources 260 can be linked directly to the opening of the vehicle closure if desired. This involves linking the light sources 260 to a switching mechanism associated with the latching mechanism. In many circumstances, an internal compartment light may already be provided and linked to a sensing device for the vehicle closure, so that the wires for the light sources 260 can be simply connected. The light sources 260 can be secured to the backing plate 209, the guide rails 220, or another stationary portion of the striker concealment mechanism 200.

Figure 13:
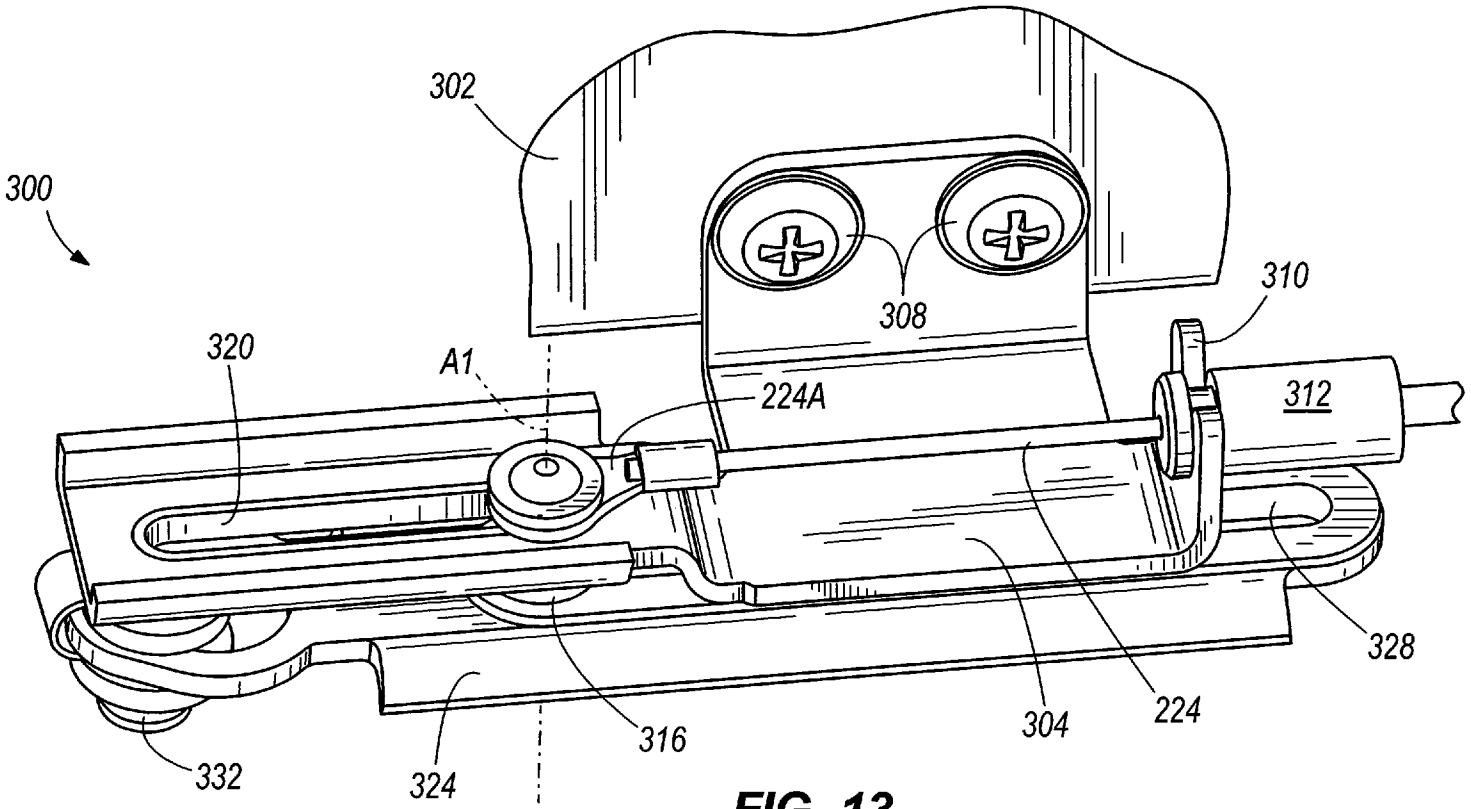
FIG. 13 is a view of an actuation mechanism for a striker concealment mechanism, shown in a first configuration.
Figure 14:
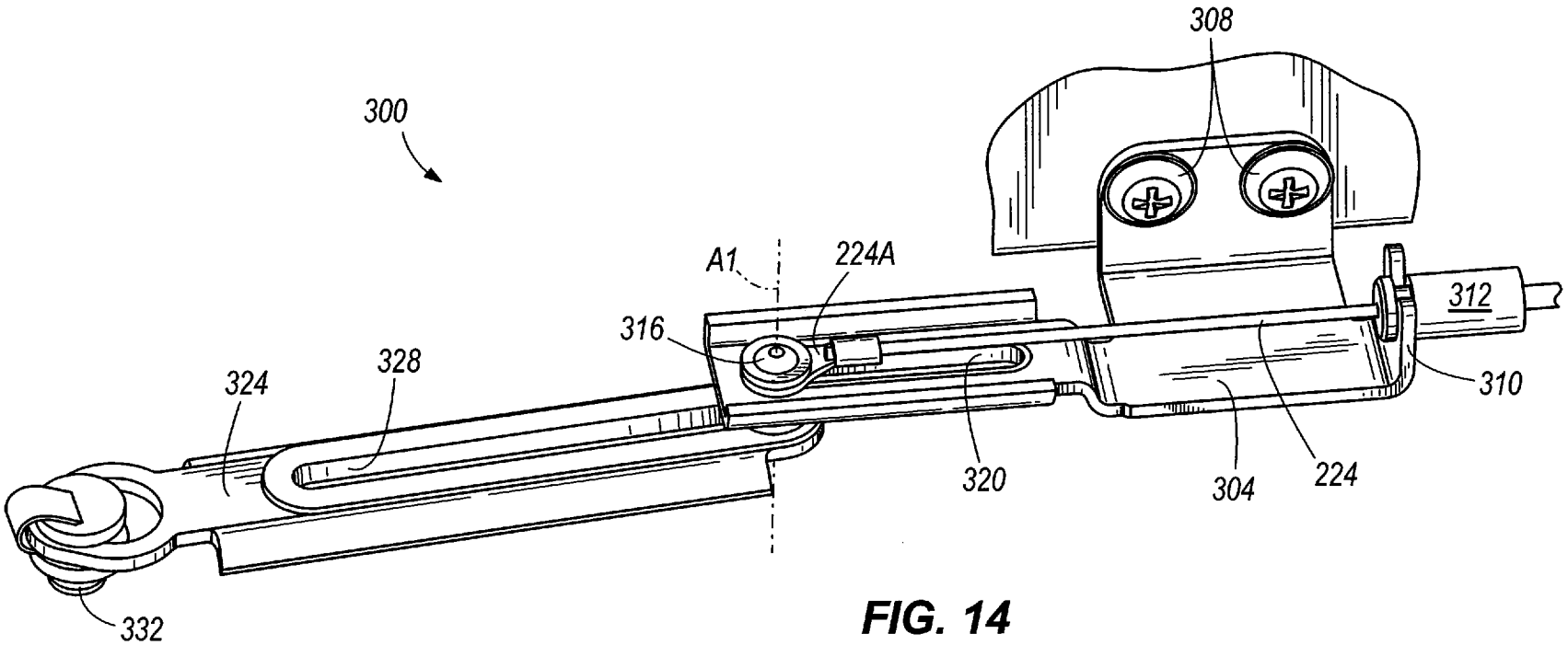
FIG. 14 is a view of the actuation mechanism of FIG. 13 in a second configuration.

FIGS. 13 and 14 illustrate an actuation mechanism 300, which is configured to couple to the movable vehicle closure, a stationary vehicle portion 302 which is adjacent the vehicle closure, and at least one striker cover or door (e.g., via cable 224). The mechanism 300 includes a first bracket 304 which is configured to be secured to the stationary vehicle portion 302. In the illustrated construction, the first bracket 304 is substantially L-shaped and includes two apertures for corresponding fasteners 308. The first bracket 304 includes a cable retainer portion 310, which secures the position of a cable sleeve end fitting 312 of the first cable 224. An end 224A of the first cable 224 terminates at a pivot pin 316 that is secured in a slot 320 of the first bracket 304. The pivot pin 316 defines an axis A1 and couples the first bracket 304 with a second bracket 324. The second bracket 324 also includes a slot 328, within which another portion of the pivot pin 316 is retained.

Thus, the first and second brackets 304, 324 are pivotable about the axis A1 of the pivot pin 316. The first and second brackets 304, 324 are also configured to slide relative to each other due to the slots 320, 328.

At a remote end of the second bracket 324, a fastener 332 is provided to secure the mechanism 300 to a portion of the vehicle closure (e.g., a decklid gooseneck). The fastener 332 can be a bolt, screw, rivet, or any other suitable fastener. The slots 320, 328 provide lost motion so that the amount of movement of the vehicle closure is reduced to an amount of cable pull that is required to actuate the doors 204, 208. The pivot pin 316 enables the vehicle closure and the fastener 332 at the end of the second bracket 324 to experience complex planar motion (rotation and translation as necessary) while the cable sleeve end fitting 312 remains fixed relative to the vehicle.

Although the invention has been described in detail with reference to certain preferred embodiments, variations and modifications exist within the scope and spirit of one or more independent aspects of the invention. For example, in some embodiments, the doors may be opened and closed by one or more electrical devices (e.g., an electric motor or solenoid). In such embodiments, the electrical device(s) may be connected to a sensor that monitors the position of the vehicle closure relative to the striker. As the closure is closed, the electrical device(s) may actuate the doors to the open position. Conversely, as the closure is opened, the electrical device(s) may actuate the doors to the closed position. In still other embodiments, the doors may be actuated by one or more magnetic devices or other actuator(s) (e.g., hydraulic or pneumatic cylinders, among others).

In other embodiments, by way of example only, the relative positions of the latch mechanism and the striker may be reversed. That is, the striker can be located on the vehicle closure and the latch mechanism which interacts with the striker can be located on a corresponding stationary portion of the vehicle. In such embodiments, the striker concealment mechanism may also be located on the vehicle closure to selectively conceal the striker.

What is claimed is:

1. A vehicle closure assembly comprising:

a closure movable relative to a vehicle opening between a closed position substantially preventing passage into the vehicle opening and an open position substantially allowing passage into the vehicle opening;

a latching assembly including a latch coupled to one of a threshold of the vehicle opening and the closure, and a striker coupled to the other of the threshold of the vehicle opening and the closure, the striker and the latch being engageable to secure the closure in the closed position;

a striker cover movable relative to the striker between a concealing position in which the striker is substantially concealed from the latch, and an exposing position in which the striker is substantially exposed to the latch; and an actuator coupled to the striker cover and operable to move the striker cover to at least one of the concealing position and the exposing position from the other of the concealing position and the exposing position in response to movement of the closure relative to the vehicle opening, wherein the striker cover is movable to the exposing position without contact made between the striker cover and the latching assembly.

2. The vehicle closure assembly of claim 1, wherein the vehicle opening is an exterior opening, and the closure is one of a decklid, a tailgate, a liftgate, and a hatchback configured to selectively provide access to a cargo area of the vehicle.

3. The vehicle closure assembly of claim 1, wherein the vehicle opening is an exterior opening, and the closure is a door configured to selectively provide human access to an interior of the vehicle.

4. The vehicle closure assembly of claim 1, wherein the closure is a cargo area closure within an interior of the vehicle.

5. The vehicle closure assembly of claim 1, wherein the actuator includes a cable coupled between the striker cover and the closure to transmits movement of the closure to the striker cover.

6. The vehicle closure assembly of claim 5, wherein the striker cover is a first striker cover and the vehicle closure assembly further comprises a second striker cover movable between concealing and exposing positions, and wherein the actuator includes at least one cable coupled to the second striker cover.

7. The vehicle closure assembly of claim 6, the first and second striker covers move toward each other to the concealing positions and away from each other to the exposing positions.

8. The vehicle closure assembly of claim 7, wherein the actuator includes a first cable secured to the first striker cover and a second cable secured to the second striker cover.

9. The vehicle closure assembly of claim 8, wherein the second cable is routed around a pulley and further secured to the first striker cover.

10. The vehicle closure assembly of claim 1, wherein the striker cover is biased to the concealing position and is actuable by the actuator to move to the exposing position.

11. The vehicle closure assembly of claim 1, wherein the striker cover is biased by a spring to the exposing position and is actuable by the actuator to move to the concealing position.

12. The vehicle closure assembly of claim 1, wherein the striker is positioned in a recess so as not to be protruding, the recess has an opening, and the striker cover is configured to cover the recess opening.

13. The vehicle closure assembly of claim 1, wherein the striker cover is slidable relative to the striker.

14. The vehicle closure assembly of claim 1, wherein the striker is provided at the threshold of the vehicle opening, and the latch is coupled to the closure and movable therewith.

15. A method of selectively concealing a striker on a vehicle, comprising:

providing a closure in a closed position and a latched configuration relative to a vehicle opening;

unlatching the closure and opening the closure relative to the vehicle opening; and actuating a striker cover to move into a first position substantially concealing the striker in response to the opening of the closure, wherein during movement of the closure towards the vehicle opening, the striker cover moves towards an open position prior to the arrival of a latch assembly.

16. The method of claim 15, further comprising moving the closure toward the closed position, and in response, moving the striker cover to a second position to substantially expose the striker for latching.

17. The method of claim 16, wherein the striker cover is actuated directly by movement of the closure as the closure is moved.

18. The method of claim 17, wherein the striker cover is moved by a cable coupled between the closure and the striker cover.

19. The method of claim 15, wherein the striker cover is a first striker cover, the method further comprising actuating a second striker cover to move into a first position substantially concealing the striker in response to the opening of the closure.

20. The method of claim 19, further comprising moving the first and second striker covers toward each other when moving to the respective first positions.

21. The method of claim 20, wherein the first and second striker covers are moved toward each other by a biasing element.

22. The method of claim 20, wherein the first and second striker covers are actuated to overcome a biasing force when moved toward each other.

23. The method of claim 15, wherein the striker cover is actuated to move into the first position along a linear path.

24. A vehicle closure assembly comprising:

a closure movable relative to a vehicle opening between a closed position substantially preventing passage into the vehicle opening and an open position substantially allowing passage into the vehicle opening;

a latching assembly including a latch coupled to one of a threshold of the vehicle opening and the closure, and a striker coupled to the other of the threshold of the vehicle opening and the closure, the striker and the latch being engageable to secure the closure in the closed position;

a striker cover movable relative to the striker between a concealing position in which the striker is substantially concealed from the latch, and an exposing position in which the striker is substantially exposed to the latch;

an actuator coupled to the striker cover and operable to move the striker cover to at least one of the concealing position and the exposing position from the other of the concealing position and the exposing position in response to movement of the closure relative to the vehicle opening, wherein the actuator includes at least one cable coupled to the striker cover.

* * * * *